US005147242A

United States Patent [19]

Lowe, Jr.

[11] Patent Number: 5,147,242

[45] Date of Patent: Sep. 15, 1992

[54] NEGATIVE AIR BAG

[76] Inventor: Robert E. Lowe, Jr., Box 84, Custer, Mont. 59024

[21] Appl. No.: 608,388

[22] Filed: Nov. 2, 1990

[51] Int. Cl.[5] ..... F24F 7/00

[52] U.S. Cl. ..... 454/63; 55/385.2; 312/1

[58] Field of Search ..... 98/115.3, 115.4; 55/1, 55/97, 385.2, 467; 312/1

[56] References Cited

U.S. PATENT DOCUMENTS

| | | | |
|---|---|---|---|
| 1,977,386 | 10/1934 | Holes | 98/115.4 X |
| 4,505,190 | 3/1985 | Fink et al. | 98/115.1 |
| 4,604,111 | 8/1986 | Natale | 55/385.2 X |
| 5,017,197 | 5/1991 | McGuire et al. | 98/115.4 X |

*Primary Examiner*—Harold Joyce

*Attorney, Agent, or Firm*—Bradford E. Kile; Ruffin B. Cordell; Kevin M. O'Brien

[57] ABSTRACT

A hazardous waste removal assembly includes a generally rectangular flexible bag having a front panel and a back panel joined at a lower portion of the bag to form a collection chamber. The bag is sealed such that it is impermeable to dust and other particulate matter. The assembly also includes at least one glove sleeve fashioned through the front panel of the bag to permit an operator to remove abestos from a segment of the enclosed conduit, while maintaining subatmospheric air pressure within the bag. A replacement air intake inlet valve is positioned on the front or back panel to permit the ingress of ambient air into the bag while concomitantly preventing egress of air or particulate contents out of the bag.

5 Claims, 5 Drawing Sheets

NEGATIVE AIR BAG

BACKGROUND OF THE INVENTION

This invention relates to a novel hazardous waste removal system. More specifically, this invention relates to a system for removal of hazardous waste, such as asbestos, from tubular conduits and the like.

In the past, asbestos containing materials have been used to insulate pipes and valves in chemical processing plants, commercial and residential buildings, and in other installations requiring insulation and fire resistant coverings. It has now been documented that exposure to asbestos may lead to cancer. Cancer-related maladies linked to asbestos are generally classified into five different categories, including asbestosis, a type of pulmonary disease caused by inhalation of asbestos-containing dust; pleural disease, which relates to changes in the pleura (the membranes enveloping the lungs and pleural cavity) caused by inhalation of the asbestos fibers; lung cancer; mesothelioma, a form of cancer of the pleural and peritoneal cavities; and other cancers such as laryngeal cancer and cancer of the gastrointestinal tract. Since the discovery of the cancer-causing propensities of asbestos-containing materials, efforts have been made to eliminate sources of asbestos fiber pollution of ambient air.

Asbestos, a fibrous form of magnesium and calcium silicate ore, is a friable material which may release microscopic fibers into the air. This presents a health hazard to workers responsible for removing asbestos-containing insulation materials. Consequently, elaborate provisions and regulations have been enacted to control the removal of these materials to minimize risk to workmen.

The use of protective bag assemblies for isolating asbestos-coated conduits and/or protective clothing, including face masks to prevent inhalation of air borne fibers, have become mandatory accessories for workmen involved in removing asbestos-containing insulation.

In order to comply with the established regulations, assemblies have been devised to prevent the propagation of these contaminants into the atmosphere. In this connection, numerous waste removal systems have been designed utilizing a glove bag concept. One such glove bag removal system includes a detachable bag which sealingly encompasses a section of a pipe to be cleaned. A pair of specially shaped flaps are secured to a longitudinal axis of the pipe to form a circumscribing sleeve portion about the pipe. The bag also includes an internal tool pouch and inwardly extending armholes to permit a user to strip the fibrous material from the pipe while remaining isolated from the asbestos-containing materials. A lower portion of the ba collects the removed contaminant material in a separate collection compartment, and the collection compartment is then sealed and removed from a reusable upper portion of the bag.

The configuration described above is problematic, however, because airborne fibers may remain in the reusable upper portion of the bag and escape into the ambient air when the collection compartment is detached from the upper portion of the assembly, exposing the worker to the contaminant.

In order to prevent escape of particles from a glove bag, a more recent improved glove bag included an inlet for a vacuum probe which was inserted into the bag to maintain the interior of the bag at a negative pressure during removal of the waste material. The negative pressure gradient ensured that the airborne contaminants were captured and removed by the vacuum probe. Such glove bags also typically included one or more openings for water spray lines or water nozzles as an extra safety precaution for making the material less friable by wetting it down.

Though the use of a vacuum reduced the risk of leakage of the fibrous contaminant material into the air, the vacuum also introduced problems associated with working in a negative pressure area. More specifically, the bag was drawn inward and, thus, restricted the working area inside the bag so that an operator has little room to manipulate tools used to remove the material from the pipe. Moreover, the negative pressure drew the opposite sides of the bag together, closing off passage to a lower portion of the bag, thereby preventing contaminant material from accumulating in the lower portion of the bag. Also, a sudden loss in negative pressure permitted airborne contaminant fibers to potentially escape from the glove bag through water inlet openings.

To permit passage of the contaminant material to a collection compartment, various cages constructed of metal or other suitable rigid materials were used in conjunction with the glove bag. Typically, the cage was mounted about the pipe, and, when negative pressure was introduced into the bag, the cage prevented the opposing sides of the bag from collapsing together. One embodiment of such an arrangement included a metal frame extending below a conduit and supporting a rigid cylindrical cage. However, these metal frame and cage assemblies tended to be cumbersome to assemble. Further, such assemblies restricted access to areas of the pipe obstructed by the frame, and the frame limited the mobility of the glove portions of the bag. Moreover, the cage assembly and associated frame were expensive and, thus, not cost effective.

The difficulties suggested in the preceding are not intended to be exhaustive but rather are among many which may tend to reduce user satisfaction with prior hazardous waste removal assemblies. Other noteworthy problems may also exist; however, those presented above should be sufficient to demonstrate that hazardous waste removal assemblies appearing in the past will admit to worthwhile improvement.

OBJECTS AMD BRIEF SUMMARY OF THE INVENTION

OBJECTS

It is therefore a general object of the invention to provide a novel hazardous waste removal assembly which will obviate or minimize difficulties of the type previously described.

It is a specific object of the invention to provide a hazardous waste removal assembly which protects a worker from exposure to contaminant-containing materials during removal procedures.

It is another object of the invention to provide a hazardous waste removal assembly which maintains a high negative pressure within the flexible bag to prevent aeration of contaminant-containing materials.

It is still another object of the invention to provide a hazardous waste removal assembly which prevents efflux of a contaminant if a loss of negative pressure within the flexible bag occurs.

It is a further object of the invention to provide a hazardous waste removal assembly which is adequately flexible to permit a worker to extend his arms around a contaminant coated conduit.

It is yet a further object of the invention to provide a hazardous waste removal assembly which may be facilely translated along a conduit without loss of the negative pressure gradient.

It is still a further object of the invention to provide a hazardous waste removal assembly which may be utilized on high temperature conduits without risk of damage to the integrity of the assembly.

It is yet another object of the invention to provide a hazardous waste removal assembly which permits regulation of the negative pressure gradient within the removal assembly.

It is yet still another object of the invention to provide a hazardous waste removal assembly which is disposable, portable, inexpensive to manufacture, and easily manipulated.

BRIEF SUMMARY OF A PREFERRED EMBODIMENT OF THE INVENTION

A preferred embodiment of the subject hazardous waste removal assembly which is intended to accomplish at least some of the foregoing objects includes a generally rectangular flexible bag having a front panel and a back panel joined at a lower portion of the bag to form a collection chamber. The upper portion of the front and back panels operably extend above the conduit and are joined together so that the conduit extends laterally between the upper and lower portions. Lateral edges of the flexible bag are operably secured about the periphery of the conduit extending through the bag. The bag is sealed such that it is impermeable to dust and other particulate matter.

The assembly also includes at least one glove sleeve fashioned through the front panel of the bag to permit a operator to remove asbestos from a segment of the enclosed conduit. A slit is fashioned through either the front or back panel of the bag for permitting an asbestos removing tool, such as a water nozzle, to be inserted into the bag. A second slit is fashioned through either the front or back panel of the bag to receive a tool for operably maintaining subatmospheric air pressure within the bag. A replacement air inlet valve is positioned on the front or back panel to permit the ingress of ambient air into the bag while concomitantly preventing egress of air o particulate contents out of the bag.

THE DRAWINGS

Other objects and advantages of the present invention will become apparent from the following detailed description of a preferred embodiment thereof taken in conjunction with the accompanying drawings, wherein:

FIGS. 6A–6E are schematic views depicting a sequence of steps for removing a contaminant such as an asbestos coating from the surface of a tubular conduit or the like.

DETAILED DESCRIPTION

Figure 1:
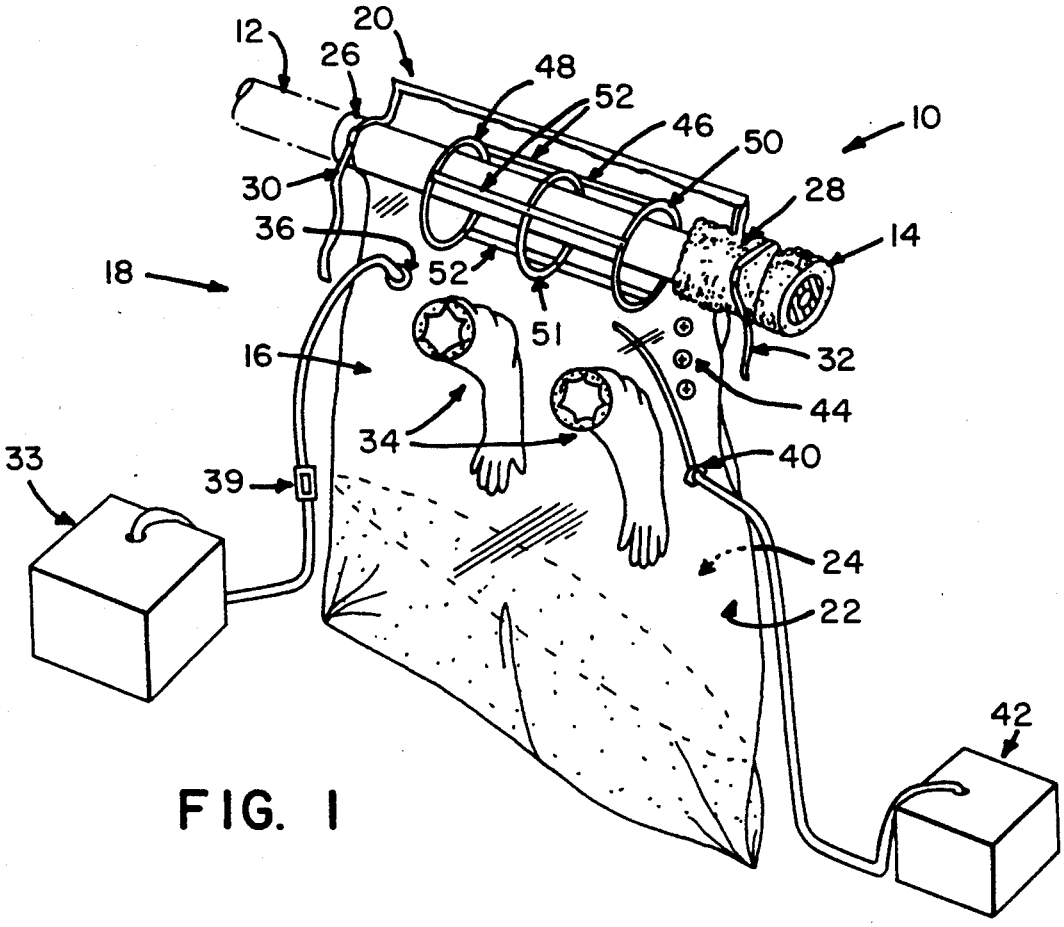
FIG. 1 is an axonometric view of a hazardous waste removal assembly in accordance with a preferred embodiment of the invention and depicts a flexible glove bag and cage member mounted around an asbestos coated conduit.

Referring now to the drawings, wherein like numerals indicate like parts, and initially to FIG. 1, there will be seen an operative context of the subject invention. More particularly, there will be seen a hazardous waste removal assembly 10 mounted about a conduit 12 which is coated with an insulative material 14 containing a contaminant, such as asbestos. The hazardous waste removal assembly 10 includes a flexible glove bag 16 composed of a transparent plastic material which isolates the asbestos from the environs. During utilization of the hazardous waste removal assembly, a lower portion 18 of the flexible bag 16 is positioned below the conduit 12 and an upper portion 20 of the flexible bag 16 extends above the conduit 12.

The flexible glove bag is generally rectangular and has a front panel 22 joined to a back panel 24 at the lower portion 18 of the bag 16 to create a collection chamber for receiving asbestos which has been removed from the conduit 12. The upper portion 20 of the front and back panels are secured together by an adherent coating such as spray glue and duct tape. Flanges 26 and 28 at lateral edges of the front panel 22 and the back panel 24 are secured about the periphery of conduit 12 by releasably attachable straps 30 and 32 to form a flexible enclosure essentially impermeable to dust and particulate matter.

A pair of glove sleeves 34 are integrally attached to the flexible glove bag 16 to permit a worker to access the asbestos coating 14. The gloves are adequately sized to permit a worker to reach all surfaces of the pipe, as well as asbestos removing tools contained within the flexible bag 16.

A vacuum line inlet 36 is fashioned through the front panel 22 of the flexible bag 16 to withdraw air from the flexible bag and thereby establish subatmospheric pressure within the bag. In a preferred embodiment of the invention, a conventional HEPA vacuum and filter system, generally indicated as 38, are used in conjunction with the subject flexible bag 16. In this connection, the subject hazardous waste removal assembly includes a regulating member 39 positioned on the vacuum line which slidably cooperates with an opening in the vacuum line to increase or decrease the negative pressure within the flexible bag. A conventional manometer may be used to monitor the negative pressure within the bag.

A water nozzle inlet 40 is also fashioned through the front panel 22 of the flexible bag for permitting the passage of water into the bag from a water sprayer 42. Replacement air inlet valves 44 are mounted on a front panel 22 of the flexible bag 16 to permit ambient air to flow into the bag, while concurrently preventing airborne fibers from leaving the bag if negative air pressure is lost. The replacement air inlet valves 44 are preferably mounted on an opposite side of the front panel 22 from the vacuum line inlet 36 to direct airborne asbestos fibers into the vacuum/filter system.

The hazardous waste removal assembly 10 also includes a cage member 46 mounted around the conduit 12 to prevent the flexible bag from adhering to the conduit when the pressure in the flexible bag becomes subatmospheric. The negative air pressure within the flexible glove bag is preferably maintained at approximately 0.07 during removal of the contaminant from the conduit; however, the cage member 46 will withstand a negative pressure up to 0.1. Additionally, the cage 46 separates the front panel 22 from the back panel 24 so that removed asbestos may have a passage to the collection chamber. Moreover, the cage member 46, which operably rests on the top of the conduit, is easily translatable so that a worker may reposition the cage along the pipe during asbestos removing procedures.

The cage member 46 generally includes a first end ring 48, a second opposing end ring 50, and four connecting straps 52 extending longitudinally between the first ring 48 and the second ring 50. In a preferred embodiment of the invention, a center ring 51 is disposed between the first end ring 48 and the second end ring 5 to strengthen the cage member. The cage member may be plied open at the location of a bolted joint on each of the rings to mount the cage about the conduit. The procedure will be described in more detail in connection with a method of removing asbestos utilizing the subject hazardous waste removal assembly.

Figure 2:
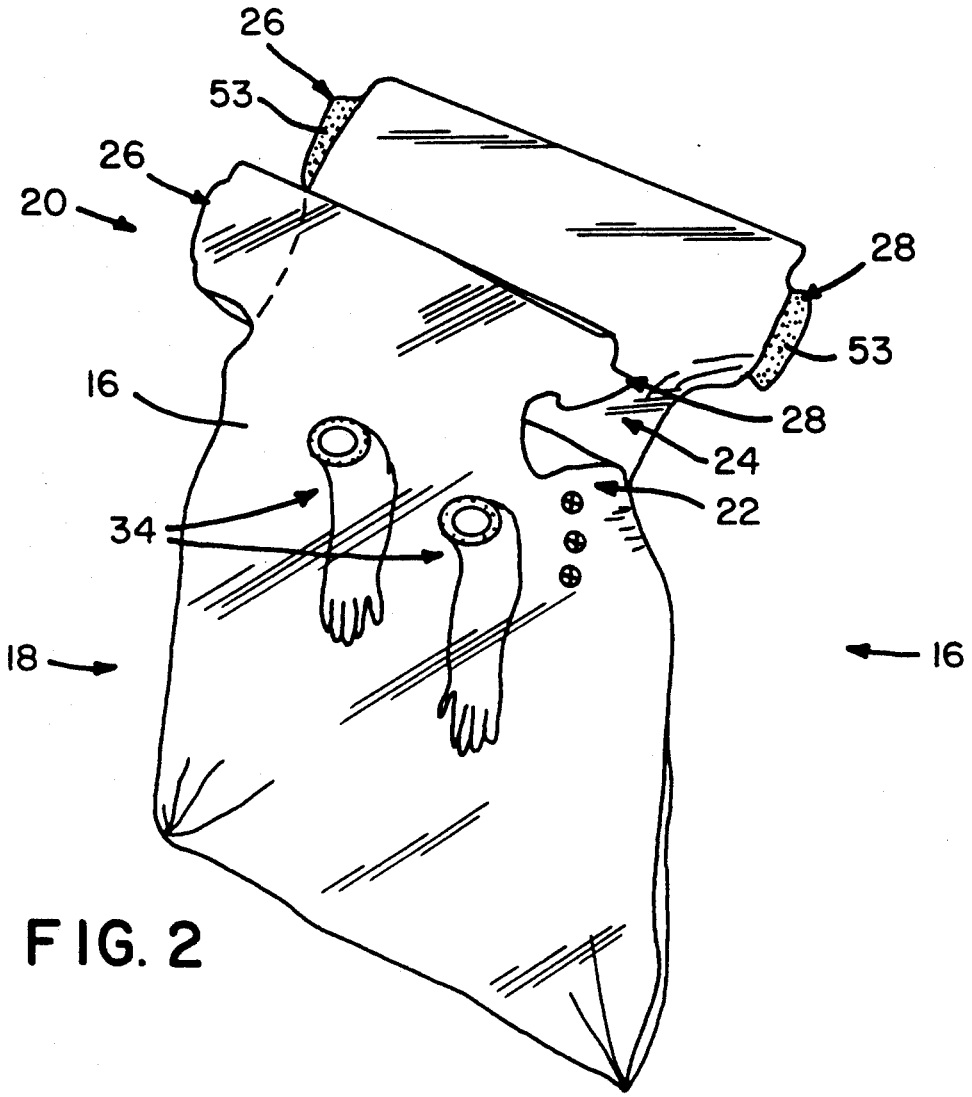
FIG. 2 is an axonometric view of the flexible glove bag having an upper portion operable to be positioned about a conduit.

FIG. 2 is a more unencumbered view of the flexible bag 16 and shows the flexible bag prior to use in conjunction with the other elements of the subject hazardous waste removal assembly. Back panel 24 is shown displaced from front panel 22 at the upper portion 20 of the flexible bag 16. Flanges 26 and 28 are coated with an insulating material 53 to prevent a hot conduit from melting the flexible bag 16.

Figure 3:
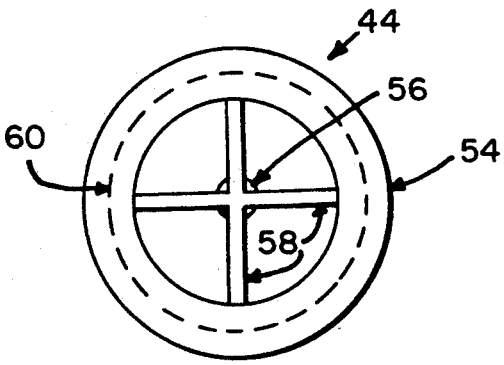
FIG. 3 is a front plan view of a replacement air inlet valve in accordance with the subject invention.

Turning now to FIG. 3, a front plan view of a replacement air inlet valve is shown. The replacement air inlet valve includes a ring member 54, a hub 56, and radiating spokes 58 which extend from the hub 56 to the ring member 54. A flexible diaphragm 60, shown in phantom, is releasably attached to back side of the inlet valve 44 by the hub 56 and extends outward from the hub 56 to cover the spokes 58. The diaphragm 60 includes a centrally located opening (not shown) which expands to go over the hub 56. The diaphragm 60 engages a shaft which connects the hub 56 to the radiating spokes 58.

The replacement air inlet valve is positioned on the flexible bag so that the diaphragm 60 is on the inner portion of the flexible bag. The silicone diaphragm flexes inward while a negative pressure gradient is maintained within the flexible glove bag to permit the ingress of ambient air; however, when the pressure inside and outside the bag are the same, the diaphragm seals against the ring member 54 in a closed position. In this way, the replacement air inlet valve serves to permit air to enter the flexible bag, but does not permit asbestos fibers to escape from the bag when the negative pressure within the bag is lost.

Figure 4:
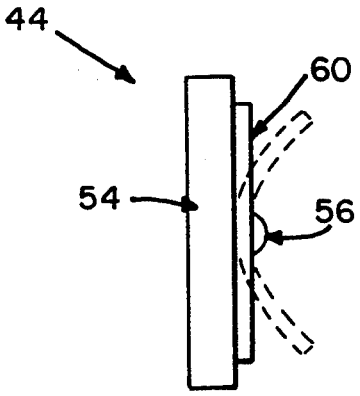
FIG. 4 is a cross sectional side view of a replacement air inlet valve.

FIG. 4 is a side view of the inlet valve 44 and shows the diaphragm 60 resting against the ring member 54 in a position to prevent egress of air contained within the flexible bag 16, as described above in connection with FIG. 1. The diaphragm 60 is also shown in phantom flexing away from the ring member 54 in a position to permit the passage of ambient air into the flexible bag 16.

Figure 5:
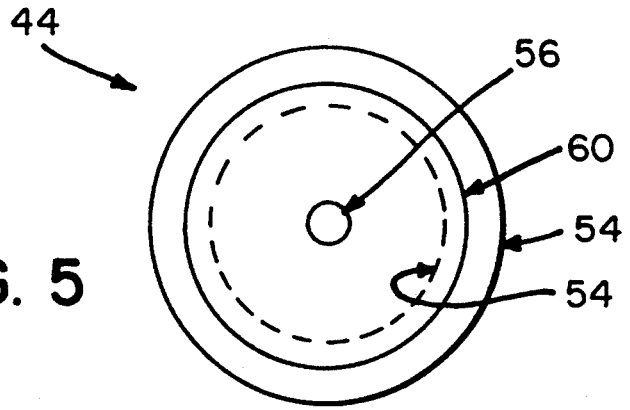
FIG. 5 is a back plan view of a replacement air inlet valve.

FIG. 5 is a back plan view of the inlet valve 44 and shows the relative dimensions of the ring member 54, flexible diaphragm 60, and hub 56.

Figure 6A:
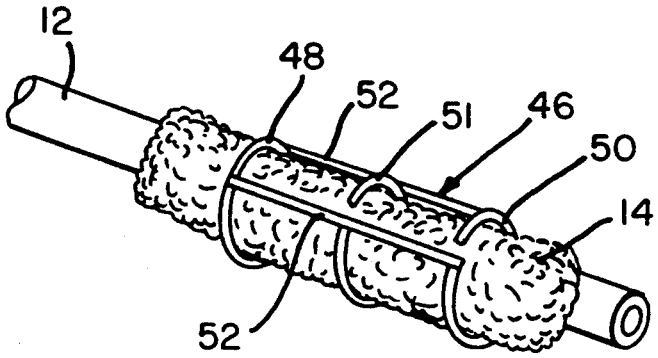

A method of removing asbestos or any other contaminant material from a conduit or the like will now be described with reference to FIGS. 6A–6E. Initially, as seen in FIG. 6A, the cage member 46 is mounted around the conduit 12. First end ring 48 is shown bolted adjacent one of the four connecting straps 52 after the cage has been positioned about the conduit. The center 51 and second end 50 rings are then bolted together so that the cage is in an operative configuration. The cage is preferably constructed at least 5 ½ inches larger in diameter than the associated conduit in order to provide adequate working space.

Figure 6B:
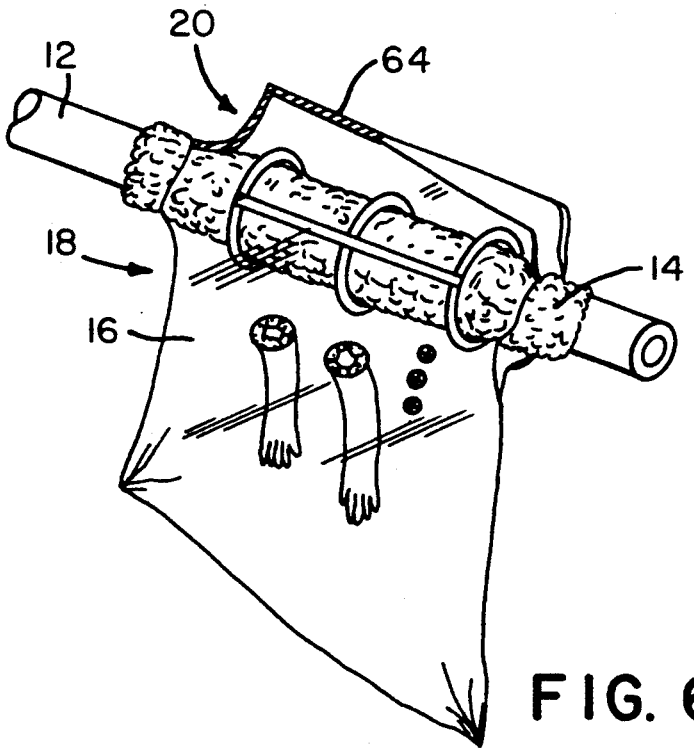

After the cage has been mounted about the conduit, the flexible bag 16 is mounted around the cage member, as shown in FIG. 6B. To mount the flexible glove bag around the conduit, the upper portion 20 of the front 22 and the back 24 panels are spray glued along the seams of the panels and then taped together by duct tape 64. The entire length of the upper portion of the flexible bag is sealed together in this manner.

Figure 6C:
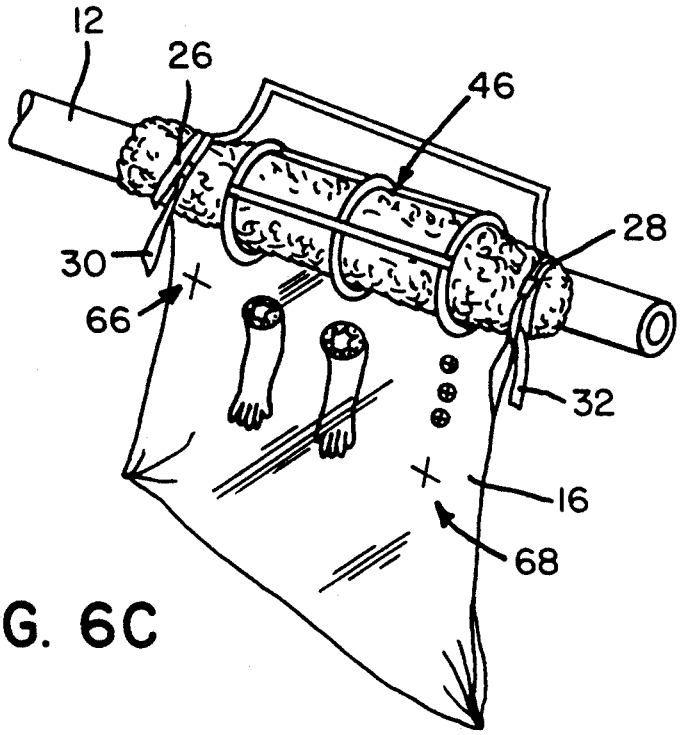

Following securement of the upper portion of the flexible bag, first 30 and second 32 releasably attachable straps are secured to lateral edges 26 and 28 of the flexible bag to tightly secure the bag to the periphery of the conduit, as shown in FIG. 6C. The straps may be adjusted to fit over asbestos, or may be tightened to fit against the conduit 12 if there is no asbestos on that section of the conduit. After the straps are secured, the flexible bag is essentially impermeable to dust and particulate matter. A first slit 66 is cut into the flexible bag 16 to permit insertion of a vacuum line, as well as an additional slit 68 to permit insertion of a water nozzle.

Figure 6D:
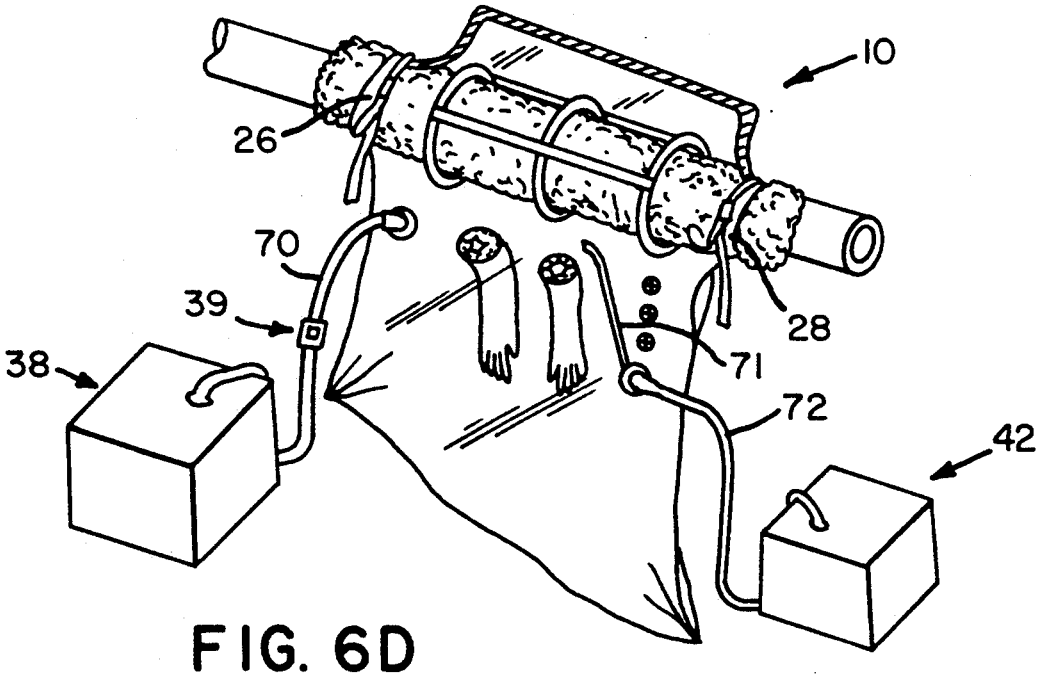

Turning now to FIG. 6D, the vacuum and filter system 38 is shown connected to the flexible bag via hose 70, which enters the bag through first slit 66. The line 70 is taped to the bag to form an essentially airtight seal. Similarly, a water nozzle 71 of the water sprayer 42 is connected to the flexible bag via hose 72 and enters the bag through the second slit 68. The hose 72 is also taped to the bag to form an airtight seal.

Figure 6E:
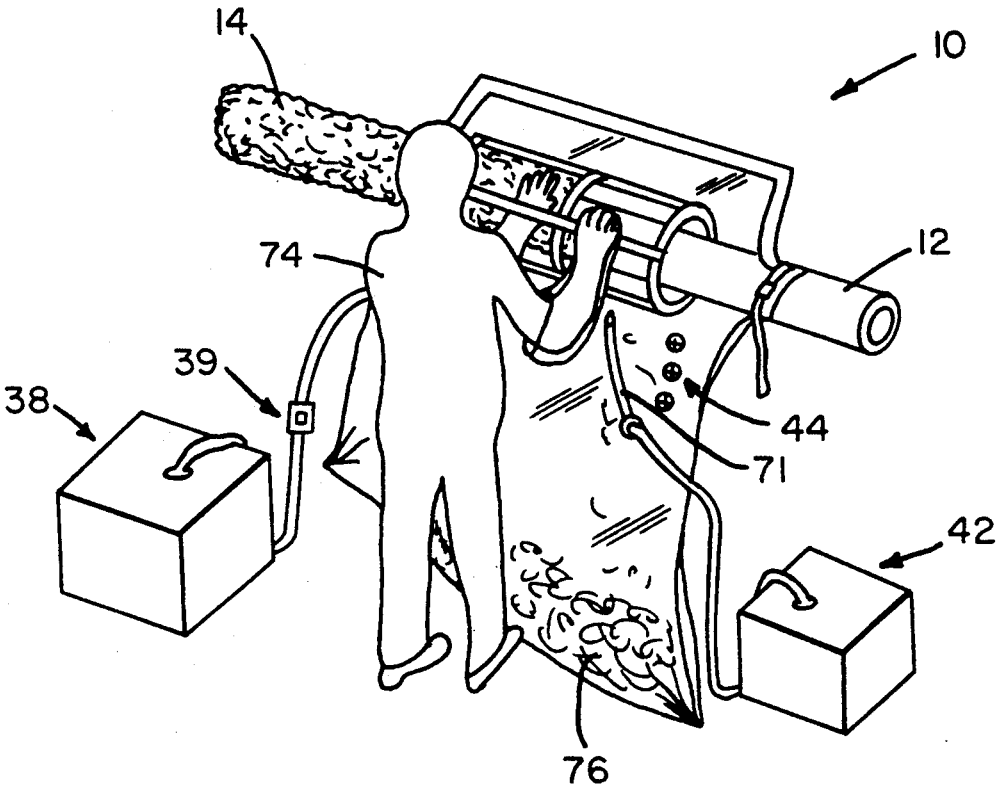

FIG. 6E depicts a worker 74 utilizing the hazardous waste removal assembly 10 to remove asbestos 14 from the conduit 12. Here, the vacuum and filter system 38 has been turned on to draw air out of the flexible bag 16 and ensure that the flexible bag has a negative pressure relative to the environs. The inlet valves 44 permit inflow of ambient air so that an air current is established within the flexible bag to direct asbestos fibers into the vacuum/filter system. Prior to stripping the asbestos from the conduit, smoke is introduced into the flexible glove bag enclosure through the replacement air valves, and the smoke flow is monitored to ensure that no air is escaping from the subject hazardous waste removal assembly.

Once the smoke-check procedure is completed, a worker may then remove asbestos from the conduit by inserting his hands into the pair of glove sleeves 34. The removed asbestos, generally designated 76 in FIG. 6E, accumulates in the bottom of the flexible bag.

After the asbestos has been removed from a section of the conduit, the worker may loosen the straps 30 and 32 and translate the bag down the conduit to a new working area. Regulatory standards require a minimum negative pressure of 0.02 in the glove bag during lateral translation along a longitudinal axis of the conduit, and the regulating member 39 permits a worker to adjust the strength of the vacuum to comply with this regulation.

SUMMARY OF MAJOR ADVANTAGES OF THE INVENTION

After reading and understanding the foregoing inventive hazardous waste removal assembly, in conjunction with the drawings, it will be appreciated that several distinct advantages of the subject invention are obtained.

Without attempting to set forth all of the desirable features of the instant hazardous waste removal assembly, at least some of the major advantages of the invention include a flexible glove bag 16 which includes a pair of working gloves 34 integrally attached to the bag. The flexibility of the bag permits a worker to have access to all areas of a coated conduit so that removal of the contaminant may be expeditiously executed. Moreover, the flexible bag ensures that a worker is protected from asbestos fibers during removal procedures. Since the bag is constructed of a plastic material, it is inexpensive and easy to manufacture.

Use of a vacuum and filter system creates a negative pressure gradient in the flexible bag so that any contaminant or particulate matter is contained within the enclosure. The regulating member 39 permits regulation of the amount of negative pressure within the flexible bag 16. Replacement air inlet valves 44 permit ambient air to flow into the flexible bag and prevent fibers from leaving the bag if negative air pressure is lost.

Cage member 46 maintains the shape of the flexible bag 16 when a negative pressure gradient is introduce into the assembly so that a worker may easily access the contaminant to be removed. Additionally, the cage member 46 separates the front and back panels of the flexible bag so that the contaminant may fall to the lower portion of the flexible bag. Moreover, the cage member may be facilely moved during lateral translation of the subject hazardous waste removal assembly.

Lateral translation of the hazardous waste removal assembly is further facilitated by the releasably attachable straps 30 and 32 which seal the flexible bag to the conduit 12, because they are easily adjusted.

Finally, the subject hazardous waste removal assembly is self-contained and disposable so there is no chance of exposure to asbestos due to reuse of contaminated parts of the assembly.

In describing the invention, reference has been made to a preferred embodiment and illustrative advantages of the invention. Those skilled in the art, however, and familiar with the instant disclosure of the subject invention, may recognize additions, deletions, modifications, substitutions, and other changes which will fall within the purview of the subject invention and claims.

What is claimed is:

1. An apparatus for subatmospheric removal of a contaminant such as an asbestos coating from the surface of tubular conduits and the like, said apparatus comprising:

a flexible bag having a generally rectangular configuration and including, a generally rectangular front panel having an upper portion operable to be positioned above the conduit and a lower portion operable to be positioned below the conduit, a generally rectangular back panel having a lower portion joined to said lower portion of said front panel to form a collection chamber and an upper portion operable to be joined to said upper portion of said front panel, means for securing said upper portion of said front panel to said upper portion of said back panel above the conduit to form an upper section of said flexible bag which operably extends above the conduit and a lower section of said flexible bag which operably extends below the conduit such that the conduit extends laterally through said flexible bag, means for securing a first lateral edge of said flexible bag about the peripheral surface of the conduit extending through said flexible bag, means for securing a second lateral edge of said flexible bag about the peripheral surface of the conduit extending through said flexible bag, said means for securing said upper portion of said front panel to said upper portion of said back panel, said means for securing said first lateral edge of said flexible bag about the conduit, and said means for securing said second lateral edge of said flexible bag about the conduit being operable to enclose a segment of the conduit to form an enclosure being essentially impermeable to dust and particulate matter;

at least one glove sleeve fashioned through said front panel and said flexible bag to permit an operator to remove asbestos from a segment of the conduit enclosed within said flexible bag;

means fashioned through at least one of said front panel and said back panel of said flexible bag for permitting an asbestos removing tool to be inserted into said bag;

means fashioned through at least one of said front panel and said back panel of said flexible bag for operably maintaining subatmospheric air pressure within said flexible bag;

at least one replacement air inlet valve positioned on at least one of said front panel and said back panel to permit the ingress of ambient air into said bag while concomitantly preventing egress of air or particulate contents of said bag out of said bag, said at least one replacement air inlet valve comprising;

a ring member;

a hub;

radiating spokes extending between said hub and said ring member; and a flexible diaphragm connected to said hub and extending to the perimeter of said ring member; and a cage member operable to be disposed around the conduit and within said flexible bag, said cage member having, a first end ring, a second opposing end ring, and at least three connecting straps extending longitudinally between said first end ring and said second end ring; and said means for securing said first lateral edge and said means for securing said second lateral edge of said flexible bag to the conduit are releasable to operably permit lateral translation of said flexible bag along the conduit as asbestos is removed from the conduit.

2. An apparatus as defined in claim 1 wherein said at least three connecting straps comprise:

four connecting straps extending longitudinally between said first end ring and said second opposing end ring.

3. An apparatus as defined in claim 1 wherein said cage member further comprises:

a third ring centrally disposed between said first end ring and said second opposing end ring.

4. An apparatus as defined in claim 3 wherein each of said means for securing said first lateral edge and said means for securing said second lateral edge to the conduit comprise:

a releasably attachable strap circumferentially engaging the periphery of the conduit.

5. An apparatus as defined in claim 1 wherein said at least one replacement air inlet valve comprises:

a plurality of replacement air inlet valves.

* * * * *